US008235173B2

(12) United States Patent
Kopp

(10) Patent No.: US 8,235,173 B2
(45) Date of Patent: Aug. 7, 2012

(54) SINGLE WAISTBAND BELT SYSTEM CONVERTIBLE BETWEEN A SIT HARNESS AND QUICK RELEASE UTILITY BELT

(76) Inventor: Christopher Kopp, Edmonton (CA)

( * ) Notice: Subject to any disclaimer, the term of this patent is extended or adjusted under 35 U.S.C. 154(b) by 326 days.

(21) Appl. No.: 12/471,623

(22) Filed: May 26, 2009

(65) Prior Publication Data

US 2010/0300802 A1 Dec. 2, 2010

(51) Int. Cl.
*A62B 1/16* (2006.01)

(52) U.S. Cl. ..... 182/6; 182/3; 182/7

(58) Field of Classification Search ..... 182/3, 6, 182/7

See application file for complete search history.

(56) References Cited

U.S. PATENT DOCUMENTS

| | | | | |
|---|---|---|---|---|
| 2,252,998 | A * | 8/1941 | Wachtel | 182/6 |
| 4,378,921 | A * | 4/1983 | Allen et al. | 244/151 R |
| 4,410,175 | A * | 10/1983 | Shamp | 482/69 |
| 5,080,191 | A * | 1/1992 | Sanchez | 182/3 |
| 5,145,027 | A * | 9/1992 | Petzl et al. | 182/3 |
| 5,360,082 | A * | 11/1994 | Bell | 182/3 |
| 5,615,750 | A * | 4/1997 | Phillips | 182/6 |
| 5,857,540 | A * | 1/1999 | Sadeck | 182/6 |
| 6,012,993 | A * | 1/2000 | Guerriero | 473/424 |
| 6,050,364 | A * | 4/2000 | Popall et al. | 182/6 |
| 6,105,169 | A * | 8/2000 | Colorado | 2/81 |
| 6,189,651 | B1 * | 2/2001 | Sadeck | 182/6 |
| 6,244,379 | B1 * | 6/2001 | Larson | 182/6 |
| 6,283,248 | B1 * | 9/2001 | Groover | 182/6 |
| 6,481,528 | B2 * | 11/2002 | Antonio | 182/6 |
| 7,341,025 | B1 * | 3/2008 | Streeter et al. | 119/857 |
| 7,445,085 | B2 * | 11/2008 | Petzl et al. | 182/6 |
| 7,490,610 | B2 * | 2/2009 | Franklin | 128/875 |
| 7,631,728 | B2 * | 12/2009 | Hill et al. | 182/3 |
| 2001/0047904 | A1 * | 12/2001 | Antonio | 182/3 |
| 2006/0207828 | A1 * | 9/2006 | D'Acquisto | 182/3 |
| 2007/0256890 | A1 * | 11/2007 | Petzl | 182/3 |
| 2008/0060873 | A1 * | 3/2008 | Lang et al. | 182/3 |
| 2009/0038884 | A1 * | 2/2009 | Helms | 182/3 |
| 2009/0077725 | A1 * | 3/2009 | Waters et al. | 2/458 |
| 2009/0078501 | A1 * | 3/2009 | Mordecai et al. | 182/6 |
| 2009/0255756 | A1 * | 10/2009 | Green | 182/3 |
| 2009/0314578 | A1 * | 12/2009 | Hede et al. | 182/3 |
| 2009/0320188 | A1 * | 12/2009 | Johnson et al. | 2/455 |

FOREIGN PATENT DOCUMENTS

FR 2580182 * 4/1985

* cited by examiner

*Primary Examiner* — Katherine w Mitchell
*Assistant Examiner* — Johnnie A Shablack
(74) *Attorney, Agent, or Firm* — Kyle R. Sutlerthwaite; Ryan W. Dupuis; Ade & Company Inc

(57) ABSTRACT

A belt system convertible into and out of a sit harness configuration for selective use as a harness or a utility belt features a pair of leg loops and a waistband equipped with a quick release buckle. Support straps projecting from the leg loops are arranged for releasable engagement to the waistband and releasable engagement to one another so that the releasable engagement to one another when also engaged to the waistband provides a second closure thereof so that the waistband remains closed by the connection between the support straps even if the quick release buckle on the waistband is inadvertently disengaged. Using only a single waistband, the belt system provides a quick release function when used only as a utility belt, yet avoids the hazard of having the waistband open by inadvertent release of the quick release waistband buckle during use as a harness.

16 Claims, 7 Drawing Sheets

SINGLE WAISTBAND BELT SYSTEM CONVERTIBLE BETWEEN A SIT HARNESS AND QUICK RELEASE UTILITY BELT

FIELD OF THE INVENTION

The present invention relates generally to a belt system adaptable from a sit harness configuration having leg loops deployed to a utility belt configuration in which the leg loops are not used, and more particularly to such a belt system in which a single quick release waistband is used in both configurations and interconnection of leg loop support straps with the leg loops deployed provides a backup closure of the waistband that remains closed should the quick release buckle inadvertently open.

BACKGROUND OF THE INVENTION

Prior art attempts have been made to provide belts that can be converted between a belt-only configuration and a harness configuration in which leg loops are suspended from the belt to cooperate therewith to form a sit harness for climbing, rappelling or other ascending, descending, hanging or suspending operations.

U.S. Pat. No. 6,189,651 teaches a belt that in its belt-only use configuration stores a pair of straps within a pair of pockets formed on the belt. For subsequent use a harness, free ends of the pair of straps opposite fixed ends secured to the belt are withdrawn from the pockets and connected to a common carabiner secured to the belt proximate the buckle thereof so that each strap loops over itself to define a respective leg loop. Without the leg loops deployed, the belt is described as being suitable for holding up trousers of the user.

U.S. Pat. No. 6,481,528 teaches a dual belt system in which an inner belt defines a waistband of a harness having selectively deployable leg loops and an outer belt secured to the harness waistband by openable connecting loops. The outer belt acts as a load bearing or utility belt to which various weapon, first aid, and/or other equipment can be carried. As is conventionally done elsewhere in the prior art, the utility belt is provided with quick release type buckle, while the harness waistband does not, instead using a standard climbing buckle to avoid the potential for a hazardous or deadly fall under accidental or inadvertent release of a quick release waistband closure.

However, there remains room for improvement in the area of convertible utility belt and harness systems. In particular, it is desirable to provide such a system which relies on only a single waistband while being capable of providing a quick release function in the utility belt context without compromising the integrity of the waistband closure during use in the harness context.

SUMMARY OF THE INVENTION

According to a first aspect of the invention there is provided a belt system comprising:

a waistband having opposing first and second ends;

a quick release buckle comprising male and female buckle components carried on the first and second ends of the waistband respectively and releasably engageable together in a snap fit to provide a first closure of the waistband;

first and second leg loops; and first and second straps each projecting from a respective one of the first and second leg loops and being arranged for releasable engagement to the waistband and releasable engagement to one another so that a connection provided between the first and second straps by the releasable engagement to one another when the releasable engagement to the waistband is made provides a second closure of the waistband so that the waistband remains closed by the connection between the first and second straps if the male and female buckle components are inadvertently disengaged from one another.

Preferably there are provided:

first and second waistband loops provided on the waistband proximate the first and second ends thereof;

a connection loop provided on each support strap and spaced from the respective leg loop; and a linking member providing a fixed connection between the first and second straps at positions therealong spaced from the first and second leg loops;

the connection loops on the first and second support straps being passable through the first and second waistband loops into and out of use positions in which the first and second straps extend through the first and second waistband loops to situate the connection loops on one side of the first and second waistband loops with the linking member extending between the first and second straps on an opposite side of the waistband straps such that selective coupling together of the connection loops when in the use position establishes the releasable engagement of the first and second straps to one another and cooperates with the linking member to provide the releasable engagement of the support straps to the waistband.

Preferably there is provided a loop forming member operable to pass through the connection loops and form a securing loop passing therethrough to form the releaseable engagement of the connection loops to one another.

The loop forming member may comprise a carabiner openable to pass through the connection loops and closeable when passed therethrough to couple the connection loops together. Alternatively, the loop forming member may comprise a length of rope passable through the connection loop for tying of rope to itself to form the securing loop, or a sling passable through the connection loops in a girth hitch.

Preferably the waistband is adjustable in length between the first and second ends thereof.

Preferably there is provided a length-adjusting buckle engaged by the waistband between the first and second ends thereof and operable to adjust the length of the waistband between the first and second ends thereof.

Preferably the first and second leg loops have first and second additional straps connected respectively thereto at points spaced from the first and second straps and connected to the waistband at distances from the where the releasable engagement of the straps to the waistband occurs.

Preferably the first and second additional straps are connected at first ends thereof to the first and second leg loops and carry releasable connection components at second ends of the first and second additional straps that are selectively engagable to mating releasable connection components carried on the waistband for selective connection therewith and disconnection therefrom.

Preferably the first and second additional straps connect to the waistband through attachment to a padding arrangement carried thereon.

Preferably the additional straps are elastic.

Preferably each leg loop comprises a releasable closure at which the leg loop is openable.

Preferably each releasable closure comprises an additional quick release buckle.

Preferably each leg loop is adjustable in size.

Preferably the connection loops are situated above the waistband loops when in the use position, with the linking member extending between the first and second straps below the waistband loops.

Preferably the linking member comprises a flexible linking strap.

Preferably each waistband loop is defined by a folded over portion of the waistband where the waistband is folded back over itself to define a respective one of the first and second ends thereof.

Preferably each folded over portion of the waistband passes through an eye of a respective one of the male and female buckle components of the quick release buckle.

BRIEF DESCRIPTION OF THE DRAWINGS

In the accompanying drawings, which illustrate an exemplary embodiment of the present invention.

DETAILED DESCRIPTION

Figure 1:
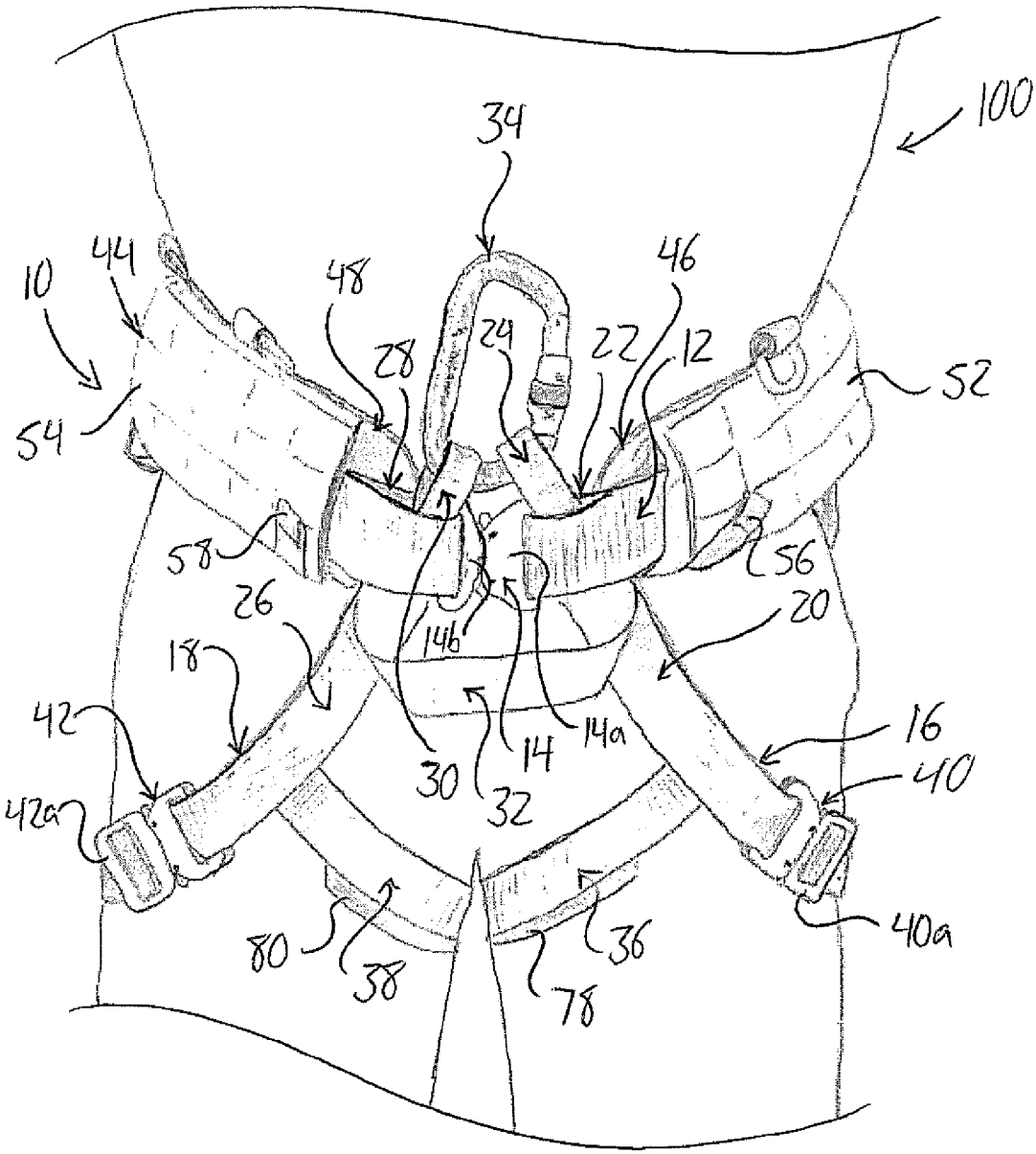
FIG. 1 is a front view of a belt system of the present invention fully fastened in a harness configuration on the torso of a user.

FIG. 1 shows a belt system 10 of the present invention installed on the torso of a user or wearer 100 in a harness-defining configuration of the system. The system features a waistband 12 sized to fit snuggly around the user's waist and equipped with a quick release buckle 14 in the form of a non-adjustable side release buckle interconnecting opposite ends of the waistband to form a fully closed waist loop around the user. At a distance below the waistband 12, a first leg loop 16 closes around the user's left leg and a second leg loop 18 likewise closes around the user's right leg. A front support strap 20 of the first leg loop 16 projects upwardly therefrom at the front of the user's left leg to pass through a respective waistband loop 22 at a first end of the waistband 12 and carry a respective connection loop 24 projecting upward through this waistband loop 22. A front support strap 26 of the second leg loop 18 projects upwardly therefrom at the front of the user's right leg to pass through a respective waistband loop 28 at a second end of the waistband 12 and carry a respective connection loop 30 projecting upward through this respective waistband loop 28.

A linking strap 32 has its opposite ends fixed to the first and second front support straps 20, 26 adjacent the first and second connection loops 24 thereof so as to extend between the front support straps 20, 26 below the waistband 12 when the connection loops 24, 30 are passed upward through the waistband loops 22, 28 to their use positions shown in FIG. 1. As will be appreciated from the drawings, the linking member limits upward movement of the support straps through the waistband loops and thereby prevents the leg loops from reaching the waistband under such upward movement of the support straps. A carabiner 34 is passed through the connection loops 24, 30 above the waistband then closed and locked to engage the front support straps 20, 26 together above the waistband. Together with the permanent connection of the front supports straps 20, 26 together below the waistband loops by the linking strap 32, this engages the support straps 20, 26 and the leg loops 16, 18 to the waistband 12. The line by which the user is to be lifted or suspended is connected to the carabiner 34 to carry the user through both the waistband and the leg loops. Even if the primary closure of the waist loop defined by the waistband and quick release buckle is inadvertently opened during use of the harness, the carabiner 34 interconnecting the front support straps 20, 26 provides a second closure of the waistband around the user's waist to prevent the waistband from separating from the user. When it becomes desirable to no longer use the belt system in a harness-requiring context, the front support straps 20, 26 can be released from the waistband 12 by simply removing the carabiner 34 and withdrawing them downward from the waistband loops 22, 28 so that subsequent opening of the waistband for removal when desired can be achieved solely through operation of the quick release buckle 14.

In the illustrated embodiment, each leg loop 16, 18 features a respective leg strap 36, 38 fixed to the respective front support strap 20, 26 between the connection of the linking strap 32 thereto and the end the front support strap 20, 26 opposite the respective connection loop 24, 30. The end of the support strap 20, 26 opposite the respective connection loop 24, 30 carries one of the male and female components of a single slide adjustment side release buckle 40, 42 forming a leg loop quick release, the other component of which is carried at the effective end of the respective leg strap 36, 38 opposite the end thereof fixed to the support strap 20, 26. Each leg loop 16, 18 is thus selectively closable in a self-locking manner around the respective leg of the user through snapping together of male and female components of the respective quick release leg loop buckle 40, 42, and openable for removal around the respective leg by release of the leg loop buckle's snap fit engagement. Each leg loop 16, 18 is also adjustable through use of a moveable mounting of the male component 40*a*, 42*a* of the respective leg loop buckle 40, 42 on the respective leg strap 36, 38 for selective sliding of the buckle component 40*a*, 42*a* along the respective leg strap 36, 38 by the user to change the effective length thereof between the fixed end secured to the respective front support strap 20, 26 and the opposite effective free end of the leg strap 36, 38. In a known manner, this may be achieved in side release buckle with a single side slide adjustment by passing the actual free end of the leg strap 36, 38 twice through an eye in the adjusting buckle component on opposite sides of a sliding bar mounted therein.

In FIGS. 1 to 4, the belt system is shown used in conjunction with a padded sleeve assembly 44 of the type being marketed by Canadian Tactical & Operational Medical Solutions Inc. (CTOMS) under the name X-Belt PS or X-Belt Padding System. The waistband 12 extends through a series of support loops (not shown) defined on two side padding bodies 46, 48 extending around the user's sides and on a rear padding body 50 situated centrally across the user's back, where the side padding bodies extend forwardly around the user's sides from adjacent opposite ends of the rear padding body 50. These support loops are situated on faces of the padding bodies facing away from the user so that the waistband 12 encloses around the user against these outer faces of the padding bodies, which provide a comfort-increasing cushion between the waistband and the user. The side padding bodies 46, 48 feature outer flaps 52, 54 pivotally secured to the top edges thereof to fold upward and downward into open and closed positions revealing and concealing the portions of the waistband extending along these padding bodies. Mating hook and loop Velcro fastener elements on opposite ones of the support loops and the flaps 52, 54 secure the flaps in the closed positions covering the waistband portions, with further locking of the flaps in these positions provided by anchor straps 56, 58 foldable over the closed flaps from the bottom edge of side padding bodies 46, 48 proximate the ends thereof from which the waistband projects to carry the waistband loops 22, 28 centrally across the front of the user to engage snap elements on the anchor straps 56, 58 with mating snap elements on the faces of the flaps opposite the Velcro fasteners.

Instead of a folding flap on the rear padding body 48, the waistband is covered here by a rear band 60 of equal height to the side flaps 52, 54 and secured to outer faces thereof by cooperation of flexible straps or tabs, each having a fixed end secured to the top edge of the rear band 60 and more rigid portion covering just under a half of the tab's length from its distal end opposite the fixed end, with PALS (Pouch Attachment Ladder System) webbing on the outer faces of the side padding bodies 46, 48 and rear band 60. The rear band includes additional support loops formed on the inner surface thereof facing the wearer, through which the waistband 12 also passes. While it is preferable that the belt system be used with some type of padding arrangement, it will be appreciated that padded sleeves or bodies of structure other than that shown and described for the illustrated embodiment may be used.

Figure 2:
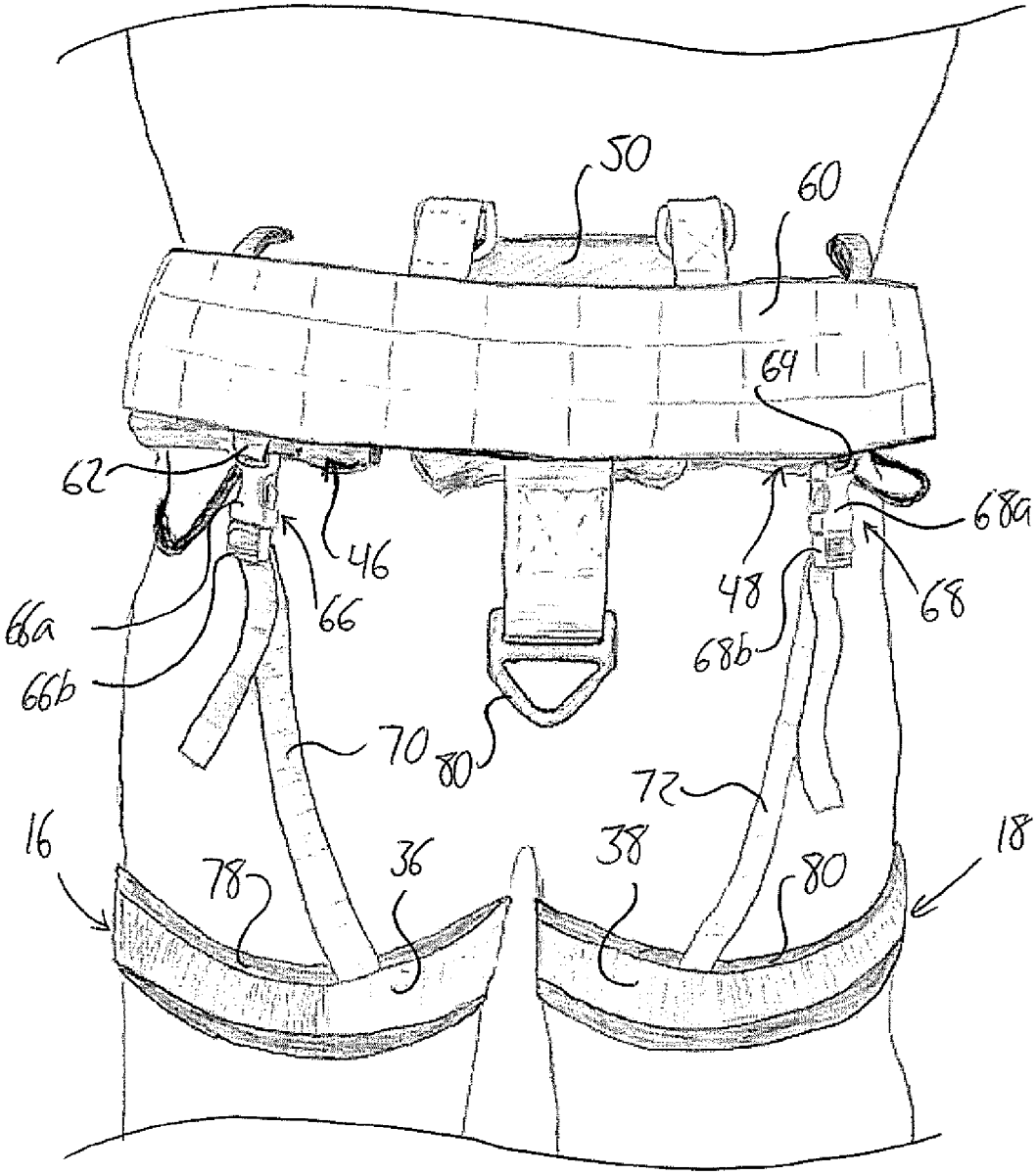
FIG. 2 is a rear view of the belt system of FIG. 1.
Figure 3:
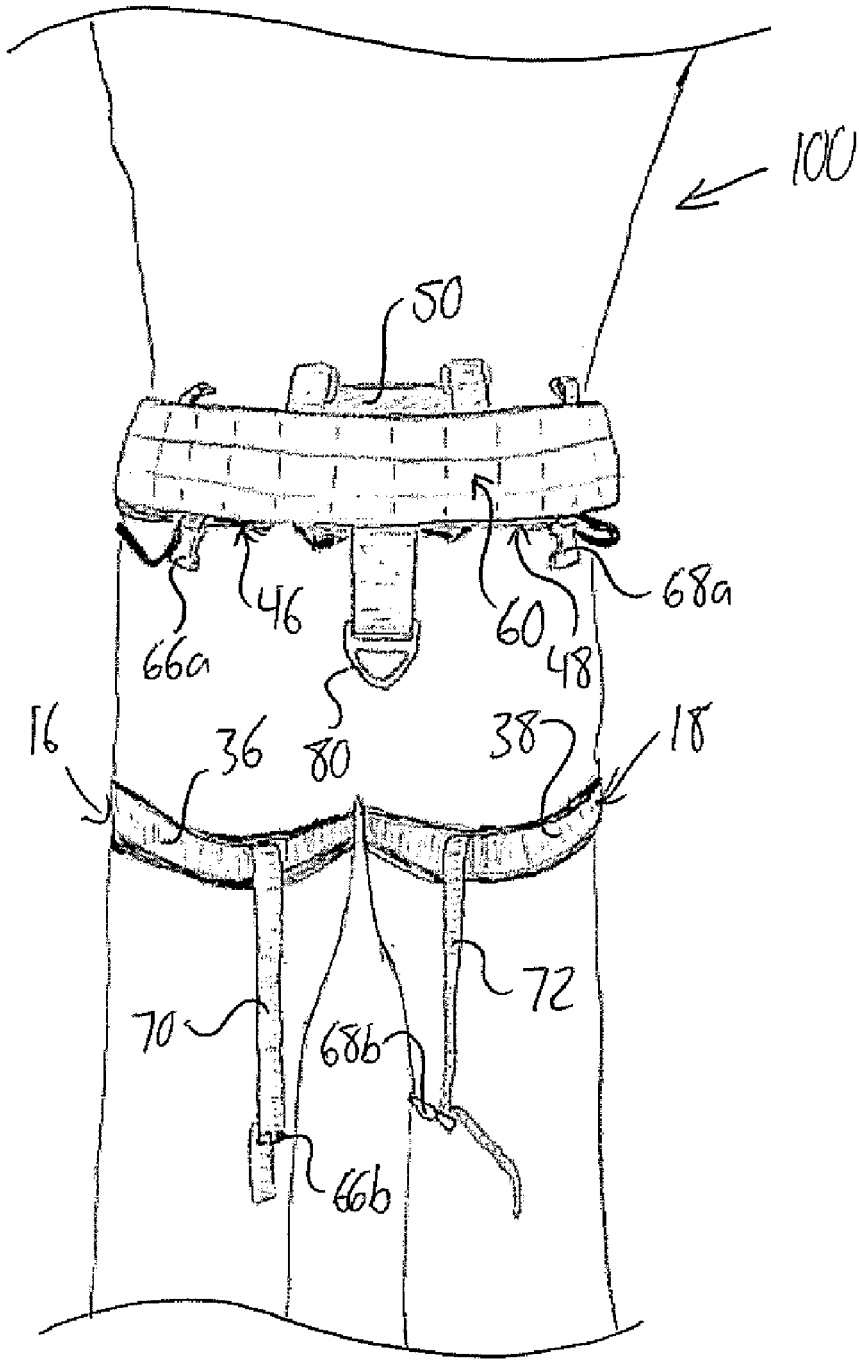
FIG. 3 is a rear view of the belt system of FIG. 1 having had rear support straps of the leg loops disconnected in a first stage of conversion from the harness configuration to a belt-only configuration.

Referring to FIGS. 2 and 3, each side padding body 46, 48 features a respective short mounting strap 62, 64 attached thereto proximate and end thereof adjacent the rear padding body 50 by closing of the strap into a loop that passes through one of the PALS webs on the outer face of the side padding body 46, 48. The mounting strap 62, 64 projects downwardly slightly past the bottom of the rear band 60 passing thereover, where it carries a female component 66*a*, 68*a* of a single ladder lock side release support buckle 66, 68 forming a quick release rear support connection for the leg loops. The male component 66*b*, 68*b* of the respective support buckle 66, 68 is carried on a respective rear support strap 70, 72 having one end fixed to the leg strap 36, 38 on the leg of the user's body over which the female component 66*a*, 68*a* with which it mates is carried. The male buckle component 66*b*, 68*b* featuring the single ladder lock adjustment of the two piece buckle is mounted for selective movement along its respective rear support strap 70, 72 for user adjustment of the effective length thereof in a known manner by sliding of the male buckle component along the strap to change the position of the effective end thereof by relative movement of the strap about a fixed bar spanning the eye of the buckle component with the strap passing twice through the eye in opposite directions on opposite sides of the bar.

With reference to FIG. 3, to convert the belt system into its belt-only configuration where the system is not needed to function as a harness, the user may start by releasing the snap fit engagement of the quick release support buckles 66, 68 to disconnect the rear support straps 70, 72 from the padding arrangement and thereby disconnect them from the waistband 12 on which the padding arrangement is carried. Next, referring to FIG. 4, the user may release the snap fit engagement of the quick release leg loop buckles 40, 42, thereby opening the leg loops 16, 18 from about the user's legs so that the leg straps 36, 38 and rear support straps 70, 72 fixed thereto hang freely from the front support straps 20, 26 that are still interconnected by the carabiner 34 above the waistband loops 22, 28 on opposite sides of the waistband closure buckle 14 and therefore remain suspended from the waistband 12. Next, the carabiner 34 above the waistband is unlocked, opened and withdrawn from the two connection loops 24, 30 of the two front support straps 20,26 so that the connection loops 24, 30 can then be drawn downwardly through the waistband loops 22, 28 to below the waistband, thereby completing the separation of the front and rear support straps and the leg straps attached thereto from the waistband.

Figure 4:
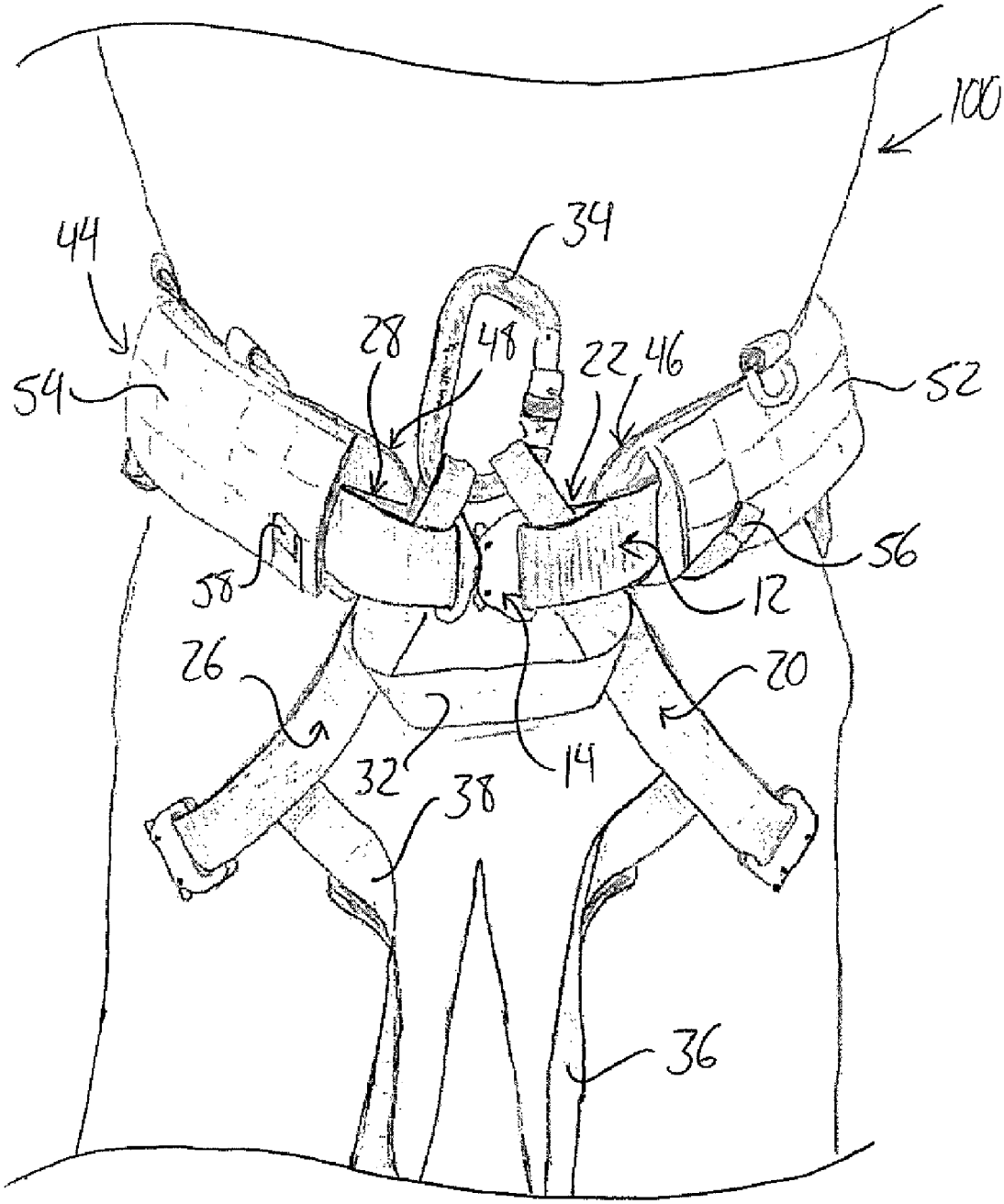
FIG. 4 is a front view of the belt system of FIG. 3 having had the leg loops opened in a second stage of the conversion from the harness configuration to the belt-only configuration.
Figure 5:
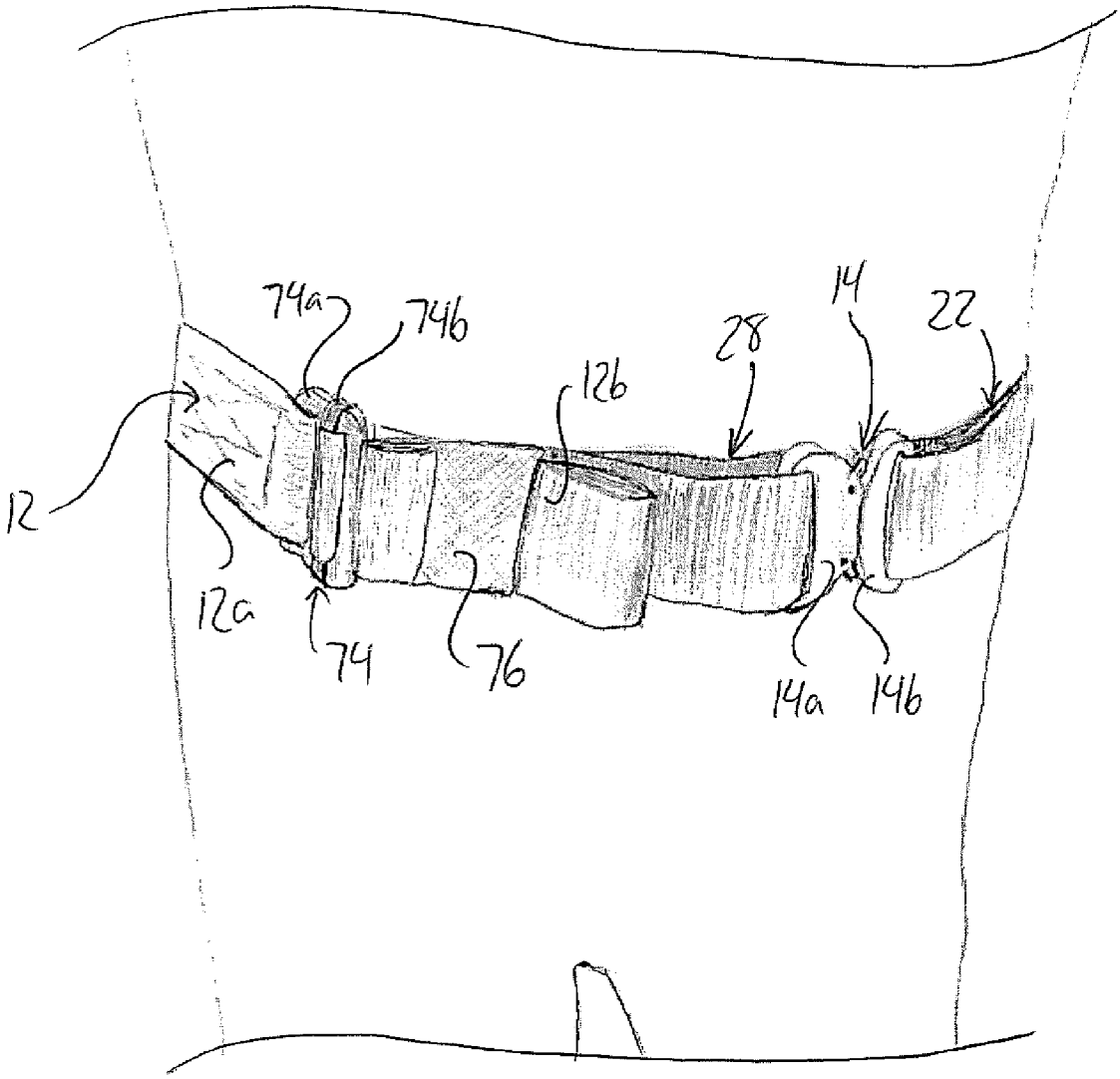
FIG. 5 is a front view of a belt system of the present invention in the belt-only configuration on the torso of a user with a padded sleeve assembly of the belt system removed for illustrative purposes.

With reference to FIG. 5, in which the padding arrangement has been omitted for illustration, this leaves the waistband supported on the user through its quick release buckle closure 14, but free of the second waist loop closure previously provided by the front support straps and carabiner so that subsequent use of the waistband, and padding arrangement if mounted thereon, as a utility belt benefits from a quick release ability, a lack of leg loops interfering with the comfort or maneuverability of the user and a lack of leg loop related straps dangling down between the users legs. Various medical, weapon related or other equipment or tools can be carried on the waistband in any known manner, including through the optional use of a PALS-equipped padding arrangement to be carried on the waistband, like that shown in FIGS. 1 to 4.

Figure 6:
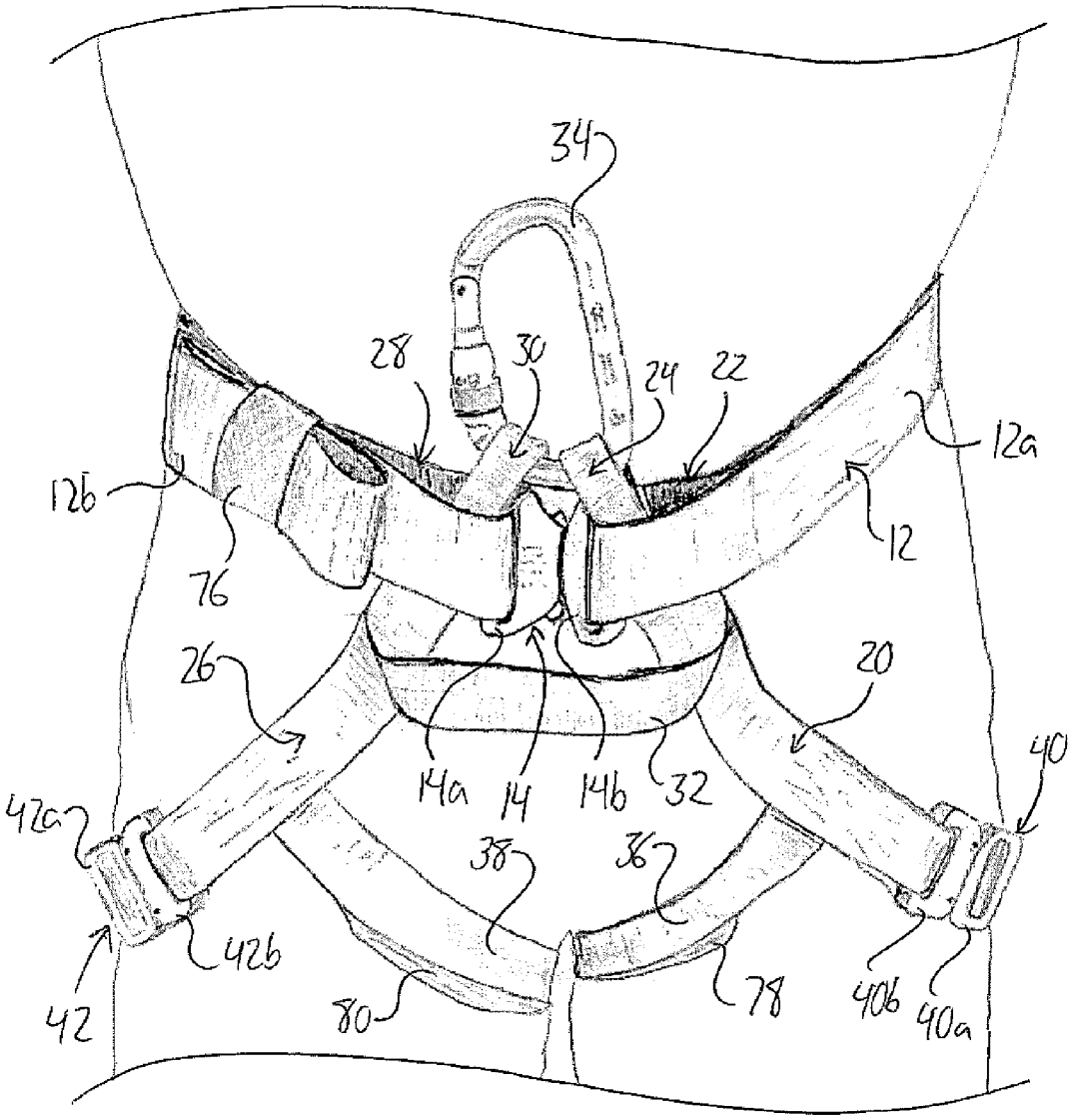
FIG. 6 is a front elevational view of the belt system of FIG. 5 with the belt system fully fastened in the harness configuration on the torso of the user.
Figure 7:
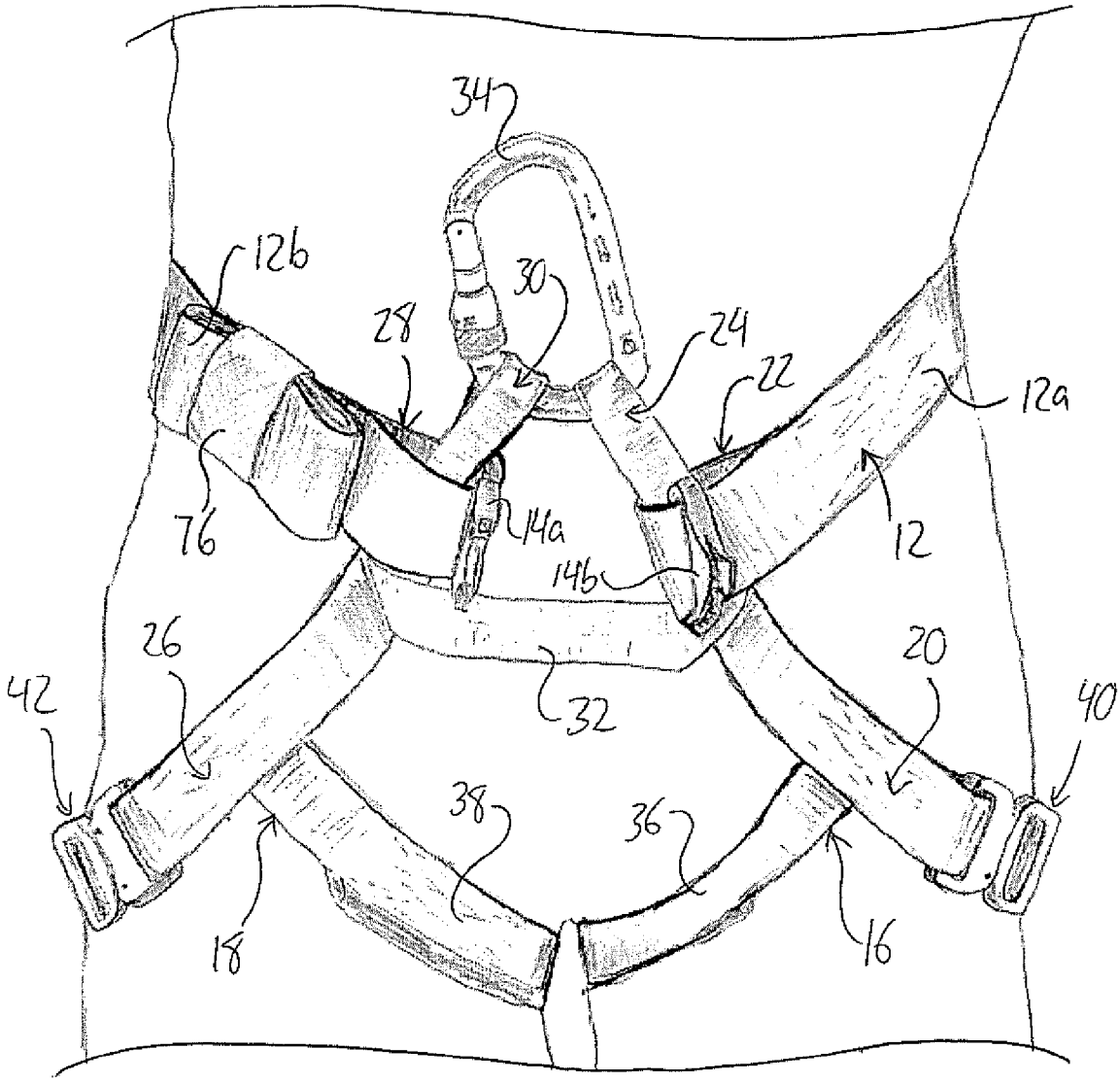
FIG. 7 is a front elevational view of the belt system of FIG. 6 with a quick release buckle of a waistband of the belt system released to illustrate how the system remains secured about the user's waist for continued safe use of the harness despite the disengagement of the quick release waistband buckle.

To return the belt system to the harness configuration, the above process is reversed. First, with the waistband closed around the user's waist by the quick release waistband closure buckle 14, the connection loops 24, 30 of the front support straps 20, 26 are passed upward through the waistband loops 22, 28 into their use positions projecting upward therefrom with the linking strap 32 crossing between the front support straps 20, 26 below the waistband loops 22, 28. The connection loops 24, 30 are then locked together using the locking carabiner 34, which acts to define the tie-in point of the harness and to complete the securing of the front support straps 20, 26 and attached leg and rear support straps 36, 38, 70, 72 to the waistband 12. The leg straps are then closed around the user's legs using the quick release leg loop buckles 40, 42, and finally the rear support straps 70, 72 are connected to the padded waistband assembly using the quick release support buckles 66, 68 to provide additional support for the leg loops 16, 18 at the user's rear. Referring to FIGS. 6 and 7, in the harness configuration, even if the first closure of the waistband 12 provided by the snap fit engagement of the waistband buckle components 14*a*, 14*b* is lost by inadvertent opening of this buckle 14, the waistband loop remains closed by the connections provided between the front support straps 20, 26 by the carabiner 34 and linking strap 32 on opposite top and bottom sides of the waistband. The conversion or adaptation of the illustrated belt system into the harness configuration benefits from the use of the carabiner's releasable connection of the support straps to perform three functions: (a) secure the front support straps and attached leg loop straps to the waistband; (b) provide a backup second closure of the waistband loop to keep the waistband closed even if the waistband quick release buckle 14 is inadvertently opened during use of the harness; and (c) define the tie-in point of the harness for connection of the support line.

With reference to FIG. 1, 4 or 5, the waistband loops 22, 28 through which the connection loop 24, 28 of the front support straps 20, 26 are passed upward to their in-use positions projecting a short distance above the waistband loops 22, 28 are formed by end portions of the waistband where it is folded back over itself and fixed back to itself at a distance from the fold with enough slack to form a loop of sufficient size to accommodate the support straps, but preferably not the carabiner. Each of these folded end portions passes through the eye opening in a respective one of the female and male components 14*a*, 14*b* of the waistband buckle 14 to form the connection thereto, thereby forming the waistband loops immediately adjacent the waistband buckle components. Since in this embodiment neither waistband buckle component 14*a*, 14*b* is movably mounted on the waistband in such a way as to allow adjustment of the effective length thereof to change the size of the waist loop defined by the waistband and its buckle closure when closed, a separate length-adjusting buckle is incorporated into the overall waistband structure.

With reference to FIG. 5, the waistband 12 is therefore divided into two separate sections 12*a*, 12*b*. A first section 12*a* defines a respective one of the waistband loops 22 at one of its end portions and extend therefrom to an opposite end portion fixed to a generally rectangular frame 74*a* of a sliding buckle 74 in a conventional manner by folding tightly about a side of the sliding buckle frame 74 to pass through the eye opening therein and extend back over itself where it is being fixed back to itself outside the buckle frame. A second section 12*b* of the waistband defines the other waistband loop 28 at one end portion thereof and extends from this waistband loop 28 to releasably engage with the sliding buckle 74 in a conventional manner by passing twice through opening of the buckle frame 74*a* in opposite directions on opposite sides of a sliding bar 74*b* around which it wraps, the sliding bar being slidable along the buckle frame toward and away from the side thereof to which the first waistband section 12*a* is fixed. The sliding buckle operates in a conventional manner to allow user adjustment of the effective length of the second waistband section between the respective waistband loop 28 formed thereby and the connection to the sliding buckle. This lengthening and shortening of the second section accordingly lengthens and shortens the overall length of the waistband between the two waistband loops 22, 28 adjacent the quick release waistband buckle components 14*a*, 14*b* defining the effective ends of the overall waistband.

An elastic band or loop 76 is fitted around the second section 12*b* of the waistband 12 so that excess length thereof not being used in the waistband's travel about the user's waist can be passed through a retaining loop defined between the elastic and the outer face of the portion of the second waistband section that is being used to span a portion of the user's waist. As shown in FIG. 5, the excess portion of the second portion 12*b* of the waistband may be folded over itself to shorten and thicken the excess waistband before tucking into the elastic retainer to prevent the excess waistband from hanging down from the rest of the waistband. Used with the padded sleeve components of the illustrated embodiment, the waistband's length adjusting buckle 74 is accessed at a respective side of the user by lifting the cover flap 54 of the respective side padding body 48 out of its closed position from over the second waistband section 12*b* into its open position revealing the length adjusting buckle, elastic retainer and any excess waistband length.

In the illustrated embodiment, each front support strap 20, 26 is doubled over with its two resulting layers fixed together at short distances from the effective ends of the straps to define the respective connection loop 24, 30 at one end and the connection to the female component 40*b*, 42*b* of the respective belt loop quick release buckle 40, 42 at the other end. At the connection loop 24, 30, the original side edges of the strap 20, 26 are folded inwardly over the strap 20, 26 and fixed to the face of the strap defining the connection loop interior, thereby reinforcing the effective connection loop edges to provide a stronger overall connection loop. Bands 78, 80 of wider width than the leg straps 36, 38 are fixed thereto between the connections thereof to the respective front support straps 20, 26 and the portions of the leg straps 36, 38 along which the male leg loop buckle components 40*a*, 42*a* are slidable to adjust the effective leg strap length. These bands or wider strap lengths 78, 80 increase the surface area against which the user's legs are fitted when the leg loops are closed. Each leg loop 16, 18 is defined by the respective leg strap 36, 38, including the widened portion 78, 80 thereof, the portion of the respective front support strap 20, 26 between the respective female leg loop buckle component 40*b*, 42*b* carried thereon and the connection of the front support strap 20, 26 to the respective leg strap 36, 38, and the respective leg loop buckle 40, 42.

Prototypes of the belt system, on which the drawings herein are based, were produced using nylon webbing for the waistband sections, the leg straps and widened bands thereon, the front support straps and the linking strap therebetween, but it will be appreciated that other materials or constructions of suitable strength and flexibility could alternatively be used and that a rigid linking member may alternatively be used. As seen in FIGS. 2 and 3, a drop down V-ring 80 was included to hang downward from the waistband 12 at a rear position thereof diametrically opposite the quick release waistband closure buckle 14 for use as an attachment point, for example in casualty extraction, but not intended as the tie-in point, which is instead provided by a screw gate locking carabiner 34 at the front of the belt when in the harness configuration. Elastic straps were used for the rear support straps and the retaining loop provided on the waistband for securing any excess length thereof after adjusting the effective overall waistband size, but it will be appreciated that the rear support straps could alternatively be provided in a non-elastic and preferably length-adjustable configuration. While rear support straps could alternatively be omitted altogether, their inclusion is preferable for the best performance and comfort in use of the sling. Metal load bearing side release buckles with single side slide adjustments from AustriAlpin were used for the snap fit or click fit quick release waistband and leg loop buckles, while generic plastic side release snap fit buckles with single side ladder lock adjustments were used on for the rear support straps. As demonstrated by comparison of FIGS. 1 and 4 with FIGS. 6 and 7, where the positions of the male and female waist buckle components are switched between these pairs of drawings, the relative positioning of the components of any buckle may be switched from those illustrated or described with reference to the preferred embodiment. Where the single adjustment side release buckles are used to provide length adjusting quick release leg loop buckles, if the male and female components are flipped around relative to the arrangement described above for the illustrated embodiment, the one of the buckle components equipped with the length adjustment should be accordingly switched as well.

It will be appreciated that the safety benefit of using a releasable-engagement connection between the front support straps to backup the quick release engagement of the waistband closure buckle 14 during use of the belt system in the harness configuration can optionally be used without other advantageous features of the illustrated embodiment, including using this same connection to complete the engagement of the leg loop components to the waistband, using this same connection as the harness tie-in point, having quick release or otherwise openable leg loops, having a sizable waistband, having sizable leg loops, having the leg loops completely detachable from the waistband, and using quick release connector buckles in rear support strap connections. As one example, an alternative embodiment could use one or more permanent connections between the leg loops and the waistband to enable storage of the belt loops and support straps within one or two pouches or pockets carried on the waistband when the front support straps are withdrawn from their use positions, rather than complete disconnection of the leg loops from the waistband when converting the system from the harness and utility belt configuration into the utility belt only configuration.

Another possible alternate embodiment could have the linking strap and the connection loops of the front support straps flipped around to switch places thereon, that is, so as to be situated above and below the waistband respectively when the leg loops are deployed in their useful positions below the waistband. However, with the other components remaining the same, installing the leg loops would require having to pass the leg straps and rear support straps downwardly through the waistband loops to their useful positions below the waistband in order to pass the buckle ends of the front support straps downward through the waistband to project their connecting loops below the waistband loops for connection together by the carabiner on the side of the waistband opposite the linking strap. Likewise, the removal of the leg loops would also require passage of the leg straps and rear support straps through the waistband loops. Therefore, the illustrated embodiment provides an easier conversion of the belt system between its two configurations, as only the connection loop ends of the front support straps need to pass through the waistband loops.

As an alternative to using the carabiner to form a rigid loop interconnecting the front support straps, one may instead use a rope passed through the connection loops of the front support straps and tied into a loop or a sling passing through the connection loops in a girth hitch. Each of these options forms a securing loop that passes through the connection loops and has a loop closure of sufficient strength to stay closed during use of the harness to keep the waist loop closed should the waistband quick release buckle come open. As described above, this securing loop may also act as the tie in point of the harness for connection of the lift, suspension or safety line and as the engagement of the support straps and attached leg loops to the waistband.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A belt system comprising:

a waistband having opposing first and second ends;

a quick release buckle comprising male and female buckle components carried on the first and second ends of the waistband respectively and releasably engageable together in a snap fit to provide a first closure of the waistband;

first and second leg loops;

first and second support straps each projecting from a respective one of the first and second leg loops;

first and second waistband loops provided on the waistband proximate the first and second ends thereof;

a connection loop provided on each support strap and spaced from the respective leg loop;

a linking member having opposite ends thereof fixed directly to the first and second support straps, respectively, at positions on said support straps that are spaced from the first and second leg loops along said support straps;

the first and second support straps being upwardly insertable into the first and second waistband loops to selectively pass the connection loops upwardly through the waistband loops into in-use positions thereabove such that selective coupling together of the connection loops when in the in-use position establishes releasable engagement of the first and second support straps to one another and to the waistband, and the first and second support straps also being downwardly retractable from the first and second waistband loops for withdrawal of the connection loops downwardly through the waistband loops from the in-use position to reposition the connection loops below the waistband loops and disengage the support straps form the waistband;

whereby the first and second support straps are arranged for releasable engagement to the waistband and releasable engagement to one another so that a connection provided between the first and second support straps by the selective coupling together thereof when in the in-use positions acts to provide a second closure of the waistband so that the waistband remains closed by the connection between the first and second support straps if the male and female buckle components are inadvertently disengaged from one another; and wherein the linking member is positioned to lie below the waistband loops when the first and second support straps extend upwardly through the waistband loops.

2. A belt system comprising:

a waistband having opposing first and second ends;

a quick release buckle comprising male and female buckle components carried on the first and second ends of the waistband respectively and releasably engageable together in a snap fit to provide a first closure of the waistband;

first and second leg loops;

first and second support straps each projecting from a respective one of the first and second leg loops;

first and second waistband loops provided on the waistband proximate the first and second ends thereof;

a connection loop provided on each support strap and spaced from the respective leg loop;

a linking member having opposite ends thereof fixed directly to the first and second support straps, respectively, at positions on said support straps that are spaced from the first and second leg loops along said support straps;

the first and second support straps being upwardly insertable into the first and second waistband loops to selectively pass the connection loops upwardly through the waistband loops into in-use positions thereabove such that selective coupling together of the connection loops when in the in-use position establishes releasable engagement of the first and second support straps to one another and to the waistband, and the first and second support straps also being downwardly retractable from the first and second waistband loops for withdrawal of the connection loops downwardly through the waistband loops from the in-use position to reposition the connection loops below the waistband loops and disengage the support straps form the waistband;

whereby the first and second support straps are arranged for releasable engagement to the waistband and releasable engagement to one another so that a connection provided between the first and second support straps by the selective coupling together thereof when in the in-use positions acts to provide a second closure of the waistband so that the waistband remains closed by the connection between the first and second support straps if the male and female buckle components are inadvertently disengaged from one another; and wherein the linking member is positioned to lie below the waistband loops when the first and second support straps extend upwardly through said waistband loops so that the linking member limits upward movement of the support straps through the waistband loops and thereby prevents the leg loops from reaching the waistband under said upward movement of the support straps.

3. The belt system according to claim 2 further comprising a carabiner openable to pass through the connection loops and closeable when passed therethrough to couple the connection loops together.

4. The belt system according to claim 2 wherein each leg loop is adjustable in size.

5. The belt system according to claim 2 wherein the linking member comprises a flexible linking strap.

6. The belt system according to claim 2 comprising a loop forming member operable to form a securing loop and the releaseable engagement of the connection loops to one another.

7. The belt system according to claim 2 wherein the waistband is adjustable in length between the first and second ends thereof.

8. The belt system according to claim 7 comprising a length-adjusting buckle engaged by the waistband between the first and second ends thereof and operable to adjust the length of the waistband between the first and second ends thereof.

9. The belt system according to claim 2 wherein each leg loop comprises a releasable closure at which the leg loop is openable.

10. The belt system according to claim 9 wherein each releasable closure comprises an additional quick release buckle.

11. The belt system according to claim 2 wherein each waistband loop is defined by a folded over portion of the waistband where the waistband is folded back over itself to define a respective one of the first and second ends thereof.

12. The belt system according to claim 11 wherein each folded over portion of the waistband passes through an eye of a respective one of the male and female buckle components of the quick release buckle.

13. The belt system according to claim 2 wherein the first and second leg loops have first and second additional straps connected respectively thereto at points spaced from the first and second support straps and connected to the waistband at distances from the where the support straps are releasably engaged to the waistband.

14. The belt system according to claim 13 wherein the first and second additional straps are connected at first ends thereof to the first and second leg loops and carry releasable connection components at second ends of the first and second additional straps that are selectively engagable to mating releasable connection components carried on the waistband for selective connection therewith and disconnection therefrom.

15. The belt system according to claim 13 wherein the first and second additional straps connect to the waistband through attachment to a padding arrangement carried thereon.

16. The belt system according to claim 13 wherein the additional straps are elastic.

* * * * *